US009175560B2

(12) United States Patent
Algeroy et al.

(10) Patent No.: US 9,175,560 B2
(45) Date of Patent: Nov. 3, 2015

(54) PROVIDING COUPLER PORTIONS ALONG A STRUCTURE

(75) Inventors: John Algeroy, Houston, TX (US); Benoit Deville, Paris (FR); Stephen Dyer, Al Khobar (SA); Dinesh Patel, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 421 days.

(21) Appl. No.: 13/358,569

(22) Filed: Jan. 26, 2012

(65) Prior Publication Data

US 2013/0192851 A1 Aug. 1, 2013

(51) Int. Cl.
*E21B 47/12* (2012.01)
*E21B 17/02* (2006.01)

(52) U.S. Cl.
CPC ..... *E21B 47/122* (2013.01); *E21B 17/028* (2013.01); *E21B 47/123* (2013.01)

(58) Field of Classification Search
CPC ..... E21B 17/028; E21B 17/023; E21B 47/09
USPC ..... 166/255.1, 378, 380, 382, 66, 242.6, 166/242.2, 250.01, 254.2; 307/104; 340/854.6, 854.8
See application file for complete search history.

(56) References Cited

U.S. PATENT DOCUMENTS

| | | | |
|---|---|---|---|
| 2,214,064 | A | 9/1940 | Niles |
| 2,379,800 | A | 7/1945 | Hare |
| 2,452,920 | A | 11/1948 | Gilbert |
| 2,470,303 | A | 5/1949 | Greenough |
| 2,782,365 | A | 2/1957 | Castel |
| 2,797,893 | A | 7/1957 | McCune et al. |
| 2,889,880 | A | 6/1959 | Hughes |
| 3,011,342 | A | 12/1961 | Simm |
| 3,199,592 | A | 8/1965 | Jacob |
| 3,206,537 | A | 9/1965 | Steward |
| 3,344,860 | A | 10/1967 | Voetter |
| 3,363,692 | A | 1/1968 | Bishop |
| 3,659,259 | A | 4/1972 | Chaney, Jr. et al. |
| 3,913,398 | A | 10/1975 | Curtis |
| 4,027,286 | A | 5/1977 | Marosko |
| 4,133,384 | A | 1/1979 | Allen et al. |
| 4,241,787 | A | 12/1980 | Price |
| 4,415,205 | A | 11/1983 | Rehm et al. |
| 4,484,628 | A | 11/1984 | Lammon, II |
| 4,559,818 | A | 12/1985 | Tsang et al. |

(Continued)

FOREIGN PATENT DOCUMENTS

| | | | |
|---|---|---|---|
| EP | 795679 | A2 | 9/1997 |
| EP | 823534 | A1 | 2/1998 |

(Continued)

OTHER PUBLICATIONS

Brown, G.A., SPE 62952. "Using Fibre-Optic Distributed Temperature Measurements to Provide Real-Time Reservoir Surveillance Data on Wytch Farm Field Horizontal Extended-Reach Wells" Society of Petroleum Engineers Inc. 2000, pp. 1-11.

(Continued)

*Primary Examiner* — Jennifer H Gay
*Assistant Examiner* — Steven MacDonald
(74) *Attorney, Agent, or Firm* — David J. Groesbeck

(57) ABSTRACT

A system or method includes providing coupler portions along a structure. The coupler portions are communicatively engageable with equipment in the structure.

12 Claims, 7 Drawing Sheets

(56) References Cited

U.S. PATENT DOCUMENTS 4,573,541 A 3/1986 Josse et al.
4,597,290 A 7/1986 Bourdet et al.
4,733,729 A 3/1988 Copeland
4,806,928 A 2/1989 Veneruso
4,850,430 A 7/1989 Copeland et al.
4,901,069 A 2/1990 Veneruso
4,945,995 A 8/1990 Tholance et al.
4,953,636 A 9/1990 Mohn
4,969,523 A 11/1990 Martin et al.
5,183,110 A 2/1993 Logan et al.
5,269,377 A 12/1993 Martin
5,278,550 A 1/1994 Rhein-Knudsen et al.
5,301,760 A 4/1994 Graham
5,311,936 A 5/1994 McNair et al.
5,318,121 A 6/1994 Brockman et al.
5,318,122 A 6/1994 Murray et al.
5,322,127 A 6/1994 McNair et al.
5,325,924 A 7/1994 Bangert et al.
5,330,007 A 7/1994 Collins et al.
5,337,808 A 8/1994 Graham
5,353,876 A 10/1994 Curington et al.
5,388,648 A 2/1995 Jordan, Jr.
5,398,754 A 3/1995 Dinhoble
5,411,082 A 5/1995 Kennedy
5,427,177 A 6/1995 Jordan, Jr. et al.
5,435,392 A 7/1995 Kennedy
5,439,051 A 8/1995 Kennedy et al.
5,454,430 A 10/1995 Kennedy et al.
5,457,988 A 10/1995 Delatorre
5,458,199 A 10/1995 Collins et al.
5,458,209 A 10/1995 Hayes et al.
5,462,120 A 10/1995 Gondouin
5,472,048 A 12/1995 Kennedy et al.
5,474,131 A 12/1995 Jordan, Jr. et al.
5,477,923 A 12/1995 Jordan, Jr. et al.
5,477,925 A 12/1995 Trahan et al.
5,499,680 A 3/1996 Walter et al.
5,520,252 A 5/1996 McNair
5,521,592 A 5/1996 Veneruso
5,533,573 A 7/1996 Jordan, Jr. et al.
5,542,472 A 8/1996 Pringle et al.
5,597,042 A 1/1997 Tubel et al.
5,655,602 A 8/1997 Collins
5,680,901 A 10/1997 Gardes
5,697,445 A 12/1997 Graham
5,706,896 A 1/1998 Tubel et al.
5,730,219 A 3/1998 Tubel et al.
5,823,263 A 10/1998 Morris et al.
5,831,156 A 11/1998 Mullins
5,871,047 A 2/1999 Spath et al.
5,871,052 A 2/1999 Benson et al.
5,875,847 A 3/1999 Forsyth
5,915,474 A 6/1999 Buytaert et al.
5,918,669 A 7/1999 Morris et al.
5,941,307 A 8/1999 Tubel
5,941,308 A 8/1999 Malone et al.
5,944,107 A 8/1999 Ohmer
5,944,108 A 8/1999 Baugh et al.
5,944,109 A 8/1999 Longbottom
5,945,923 A 8/1999 Soulier
5,954,134 A 9/1999 Longbottom
5,959,547 A 9/1999 Tubel et al.
5,960,873 A 10/1999 Alexander et al.
5,967,816 A 10/1999 Sampa et al.
5,971,072 A 10/1999 Huber et al.
5,975,204 A 11/1999 Tubel et al.
5,979,559 A 11/1999 Kennedy
5,992,519 A 11/1999 Ramakrishnan et al.
6,003,606 A 12/1999 Moore et al.
6,006,832 A 12/1999 Tubel et al.
6,035,937 A 3/2000 Gano et al.
6,046,685 A 4/2000 Tubel
6,061,000 A 5/2000 Edwards
6,065,209 A 5/2000 Gondouin
6,065,543 A 5/2000 Gano et al.
6,073,697 A 6/2000 Parlin et al.
6,076,046 A 6/2000 Vasudevan et al.
6,079,488 A 6/2000 Begg et al.
6,079,494 A 6/2000 Longbottom et al.
6,119,780 A 9/2000 Christmas
6,125,937 A 10/2000 Longbottom et al.
6,173,772 B1 1/2001 Vaynshteyn
6,173,788 B1 1/2001 Lembcke et al.
6,176,308 B1 1/2001 Pearson
6,176,312 B1 1/2001 Tubel et al.
6,192,980 B1 2/2001 Tubel et al.
6,192,988 B1 2/2001 Tubel
6,196,312 B1 3/2001 Collins et al.
6,209,648 B1 4/2001 Ohmer et al.
6,244,337 B1 6/2001 Cumming et al.
6,302,203 B1 10/2001 Rayssiguier et al.
6,305,469 B1 10/2001 Coenen et al.
6,310,559 B1 10/2001 Laborde et al.
6,318,469 B1 11/2001 Patel
6,328,111 B1 12/2001 Bearden et al.
6,349,770 B1 2/2002 Brooks et al.
6,354,378 B1 3/2002 Patel
6,360,820 B1 3/2002 Laborde et al.
6,374,913 B1 4/2002 Robbins et al.
6,378,610 B2 4/2002 Rayssiguier et al.
6,415,864 B1 7/2002 Ramakrishnan et al.
6,419,022 B1 7/2002 Jernigan et al.
6,457,522 B1 10/2002 Bangash et al.
6,481,494 B1 11/2002 Dusterhoft et al.
6,510,899 B1 1/2003 Sheiretov et al.
6,513,599 B1 2/2003 Bixenman et al.
6,515,592 B1 * 2/2003 Babour et al. ..... 340/854.4
6,533,039 B2 3/2003 Rivas et al.
6,568,469 B2 5/2003 Ohmer et al.
6,577,244 B1 6/2003 Clark et al.
6,588,507 B2 7/2003 Dusterhoft et al.
6,614,229 B1 9/2003 Clark et al.
6,614,716 B2 9/2003 Plona et al.
6,618,677 B1 9/2003 Brown
6,668,922 B2 12/2003 Ziauddin et al.
6,675,892 B2 1/2004 Kuchuk et al.
6,679,324 B2 1/2004 Den Boer et al.
6,695,052 B2 2/2004 Branstetter et al.
6,702,015 B2 3/2004 Fielder, III et al.
6,727,827 B1 4/2004 Edwards et al.
6,749,022 B1 6/2004 Fredd
6,751,556 B2 6/2004 Schroeder et al.
6,758,271 B1 7/2004 Smith
6,768,700 B2 7/2004 Veneruso et al.
6,776,256 B2 8/2004 Kostyuchenko et al.
6,787,758 B2 9/2004 Tubel et al.
6,789,621 B2 9/2004 Wetzel et al.
6,789,937 B2 9/2004 Haddad et al.
6,817,410 B2 11/2004 Wetzel et al.
6,828,547 B2 12/2004 Tubel et al.
6,837,310 B2 1/2005 Martin
6,842,700 B2 1/2005 Poe
6,845,819 B2 1/2005 Barrett et al.
6,848,510 B2 2/2005 Bixenman et al.
6,856,255 B2 2/2005 Chalitsios et al.
6,857,475 B2 2/2005 Johnson
6,863,127 B2 3/2005 Clark et al.
6,863,129 B2 3/2005 Ohmer et al.
6,864,801 B2 3/2005 Tabanou et al.
6,896,074 B2 5/2005 Cook et al.
6,903,660 B2 6/2005 Clark et al.
6,911,418 B2 6/2005 Frenier
6,913,083 B2 7/2005 Smith
6,920,395 B2 7/2005 Brown
6,942,033 B2 9/2005 Brooks et al.
6,950,034 B2 9/2005 Pacault et al.
6,975,243 B2 12/2005 Clark et al.
6,978,833 B2 12/2005 Salamitou et al.
6,980,940 B1 12/2005 Gurpinar et al.
6,983,796 B2 1/2006 Bayne et al.
6,989,764 B2 1/2006 Thomeer et al.
7,000,696 B2 2/2006 Harkins
7,000,697 B2 2/2006 Goode et al.
7,007,756 B2 3/2006 Lerche et al.

(56) References Cited

U.S. PATENT DOCUMENTS

| | | | | |
|---|---|---|---|---|
| 7,040,402 | B2 | 5/2006 | Vercaemer | |
| 7,040,415 | B2 | 5/2006 | Boyle et al. | |
| 7,055,604 | B2 | 6/2006 | Jee et al. | |
| 7,063,143 | B2 | 6/2006 | Tilton et al. | |
| 7,079,952 | B2 | 7/2006 | Thomas et al. | |
| 7,083,452 | B2 | 8/2006 | Eriksson et al. | |
| 7,093,661 | B2 | 8/2006 | Olsen | |
| 7,683,802 | B2 * | 3/2010 | Madhavan et al. | 340/854.8 |
| 7,866,414 | B2 | 1/2011 | Patel | |
| 8,082,990 | B2 | 12/2011 | Lovell et al. | |
| 2001/0013410 | A1 | 8/2001 | Beck et al. | |
| 2002/0007948 | A1 | 1/2002 | Bayne et al. | |
| 2002/0050361 | A1 | 5/2002 | Shaw et al. | |
| 2002/0096333 | A1 | 7/2002 | Johnson et al. | |
| 2002/0112857 | A1 | 8/2002 | Ohmer et al. | |
| 2003/0137302 | A1 | 7/2003 | Clark et al. | |
| 2003/0137429 | A1 | 7/2003 | Clark et al. | |
| 2003/0141872 | A1 | 7/2003 | Clark et al. | |
| 2003/0150622 | A1 | 8/2003 | Patel et al. | |
| 2003/0221829 | A1 | 12/2003 | Patel et al. | |
| 2004/0010374 | A1 | 1/2004 | Raghuraman et al. | |
| 2004/0094303 | A1 * | 5/2004 | Brockman et al. | 166/313 |
| 2004/0164838 | A1 | 8/2004 | Hall et al. | |
| 2004/0173350 | A1 | 9/2004 | Wetzel et al. | |
| 2004/0173352 | A1 | 9/2004 | Mullen et al. | |
| 2004/0194950 | A1 | 10/2004 | Restarick et al. | |
| 2004/0238168 | A1 | 12/2004 | Echols | |
| 2005/0072564 | A1 | 4/2005 | Grigsby et al. | |
| 2005/0074210 | A1 * | 4/2005 | Grigsby et al. | 385/53 |
| 2005/0083064 | A1 | 4/2005 | Homan et al. | |
| 2005/0087368 | A1 * | 4/2005 | Boyle et al. | 175/57 |
| 2005/0092488 | A1 | 5/2005 | Rodet et al. | |
| 2005/0092501 | A1 | 5/2005 | Chavers et al. | |
| 2005/0115741 | A1 | 6/2005 | Terry et al. | |
| 2005/0149264 | A1 | 7/2005 | Tarvin et al. | |
| 2005/0168349 | A1 | 8/2005 | Huang et al. | |
| 2005/0178554 | A1 | 8/2005 | Hromas et al. | |
| 2005/0194150 | A1 | 9/2005 | Ringgenberg | |
| 2005/0199401 | A1 | 9/2005 | Patel et al. | |
| 2005/0236161 | A1 | 10/2005 | Gay et al. | |
| 2005/0274513 | A1 | 12/2005 | Schultz et al. | |
| 2005/0279510 | A1 | 12/2005 | Patel et al. | |
| 2006/0000604 | A1 | 1/2006 | Jenkins et al. | |
| 2006/0000618 | A1 | 1/2006 | Cho et al. | |
| 2006/0006656 | A1 | 1/2006 | Smedstad | |
| 2006/0016593 | A1 | 1/2006 | Gambier | |
| 2006/0042795 | A1 | 3/2006 | Richards | |
| 2006/0060352 | A1 | 3/2006 | Vidrine et al. | |
| 2006/0065444 | A1 | 3/2006 | Hall et al. | |
| 2006/0077757 | A1 | 4/2006 | Cox et al. | |
| 2006/0086498 | A1 | 4/2006 | Wetzel et al. | |
| 2006/0090892 | A1 | 5/2006 | Wetzel et al. | |
| 2006/0090893 | A1 | 5/2006 | Sheffield | |
| 2006/0124297 | A1 | 6/2006 | Ohmer | |
| 2006/0124318 | A1 | 6/2006 | Sheffield | |
| 2006/0162934 | A1 | 7/2006 | Shepler | |
| 2006/0196660 | A1 | 9/2006 | Patel | |
| 2006/0225926 | A1 | 10/2006 | Madhavan et al. | |
| 2006/0254767 | A1 | 11/2006 | Pabon et al. | |
| 2006/0283606 | A1 | 12/2006 | Partouche et al. | |
| 2007/0012436 | A1 | 1/2007 | Freyer | |
| 2007/0027245 | A1 | 2/2007 | Vaidya et al. | |
| 2007/0044964 | A1 | 3/2007 | Grigar et al. | |
| 2007/0059166 | A1 | 3/2007 | Sheth et al. | |
| 2007/0062710 | A1 | 3/2007 | Pelletier et al. | |
| 2007/0074872 | A1 | 4/2007 | Du et al. | |
| 2007/0107907 | A1 | 5/2007 | Smedstad et al. | |
| 2007/0110593 | A1 | 5/2007 | Sheth et al. | |
| 2007/0116560 | A1 | 5/2007 | Eslinger | |
| 2007/0142547 | A1 | 6/2007 | Vaidya et al. | |
| 2007/0144738 | A1 | 6/2007 | Sugiyama et al. | |
| 2007/0144746 | A1 | 6/2007 | Jonas | |
| 2007/0151724 | A1 | 7/2007 | Ohmer et al. | |
| 2007/0159351 | A1 | 7/2007 | Madhavan et al. | |
| 2007/0162235 | A1 | 7/2007 | Zhan et al. | |
| 2007/0165487 | A1 | 7/2007 | Nutt et al. | |
| 2007/0199696 | A1 | 8/2007 | Walford | |
| 2007/0213963 | A1 | 9/2007 | Jalali et al. | |
| 2007/0216415 | A1 | 9/2007 | Clark et al. | |
| 2007/0227727 | A1 | 10/2007 | Patel et al. | |
| 2007/0235185 | A1 | 10/2007 | Patel et al. | |
| 2007/0271077 | A1 | 11/2007 | Kosmala et al. | |
| 2008/0066961 | A1 * | 3/2008 | Aivalis et al. | 175/50 |
| 2009/0008078 | A1 * | 1/2009 | Patel | 166/50 |
| 2009/0066535 | A1 * | 3/2009 | Patel et al. | 340/853.2 |
| 2010/0300678 | A1 * | 12/2010 | Patel et al. | 166/65.1 |
| 2011/0011580 | A1 * | 1/2011 | Clark et al. | 166/244.1 |
| 2011/0284219 | A1 * | 11/2011 | Pomerantz et al. | 166/264 |
| 2013/0087325 | A1 * | 4/2013 | Bartko et al. | 166/250.1 |
| 2013/0120093 | A1 | 5/2013 | Deville et al. | |

FOREIGN PATENT DOCUMENTS

| | | | |
|---|---|---|---|
| EP | 1158138 | A2 | 11/2001 |
| EP | 0786578 | B1 | 12/2005 |
| GB | 2274864 | A | 8/1994 |
| GB | 2304764 | A | 3/1997 |
| GB | 2333545 | A | 7/1999 |
| GB | 2337780 | A | 12/1999 |
| GB | 2345137 | A | 6/2000 |
| GB | 2360532 | A | 9/2001 |
| GB | 2364724 | A | 2/2002 |
| GB | 2376488 | A | 12/2002 |
| GB | 2381281 | A | 4/2003 |
| GB | 2392461 | A | 3/2004 |
| GB | 2395315 | A | 5/2004 |
| GB | 2395965 | A | 6/2004 |
| GB | 2401385 | A | 11/2004 |
| GB | 2401430 | A | 11/2004 |
| GB | 2401889 | A | 11/2004 |
| GB | 2404676 | A | 2/2005 |
| GB | 2407334 | A | 4/2005 |
| GB | 2408327 | A | 5/2005 |
| GB | 2409692 | A | 7/2005 |
| GB | 2416871 | A | 2/2006 |
| GB | 2419619 | A | 5/2006 |
| GB | 2419903 | A | 5/2006 |
| GB | 2426019 | A | 11/2006 |
| GB | 2428787 | A | 2/2007 |
| RU | 2136856 | C1 | 9/1999 |
| RU | 2146759 | C1 | 3/2000 |
| RU | 2171363 | C1 | 7/2001 |
| RU | 2239041 | C2 | 10/2004 |
| WO | 9623953 | A1 | 8/1996 |
| WO | 9850680 | A2 | 11/1998 |
| WO | 9850680 | A3 | 11/1998 |
| WO | 9858151 | A1 | 12/1998 |
| WO | 9913195 | A1 | 3/1999 |
| WO | 0029713 | A2 | 5/2000 |
| WO | 0171155 | A1 | 9/2001 |
| WO | 0198632 | A1 | 12/2001 |
| WO | 03023185 | A1 | 3/2003 |
| WO | 2004076815 | A1 | 9/2004 |
| WO | 2004094961 | A1 | 11/2004 |
| WO | 2005035943 | A1 | 4/2005 |
| WO | 2005064116 | A1 | 7/2005 |
| WO | 2006010875 | A1 | 2/2006 |

OTHER PUBLICATIONS

Saputelli, L. et al. "Real-Time Decision-making for Value Creation while Drilling" SPE/IADC Middle East Drilling Technology Conference & Exhibition, Oct. 2003.

Lanier et al. "Brunei Field Trial of a Fibre Optic Distributed Temperature Sensor (DTS) System in 1,DOOm Open Hole Horizontal Oil Producer" SPE 84324; SPE Annual Technical Conference and Exhibition, Oct. 5-8, 2003.

* cited by examiner

PROVIDING COUPLER PORTIONS ALONG A STRUCTURE

BACKGROUND

A well can be drilled into a subterranean structure for the purpose of recovering fluids from a reservoir in the subterranean structure. Examples of fluids include hydrocarbons, fresh water, or other fluids. Alternatively, a well can be used for injecting fluids into the subterranean structure.

Once a well is drilled, completion equipment can be installed in the well. Examples of completion equipment include a casing or liner to line a wellbore. Also, flow conduits, flow control devices, and other equipment can also be installed to perform production or injection operations.

SUMMARY

In general, according to some implementations, a system or method includes providing coupler portions along a structure. The coupler portions are communicatively engageable with equipment in the structure.

Other or alternative features will become apparent from the following description, from the drawings, and from the claims.

BRIEF DESCRIPTION OF THE DRAWINGS

Some embodiments are described with respect to the following figures.

DETAILED DESCRIPTION

Figure 1:
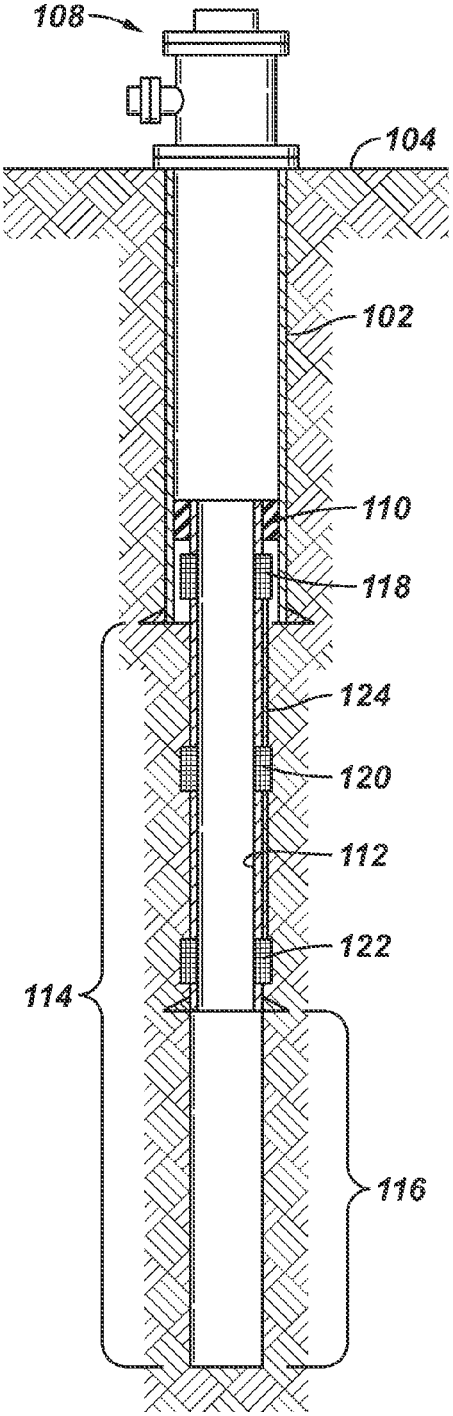
FIGS. 1-5 illustrate example arrangements having coupler portions on a liner structure to allow for communicative engagement with equipment in a well, according to various embodiments.

As used here, the terms "above" and "below"; "up" and "down"; "upper" and "lower"; "upwardly" and "downwardly"; and other like terms indicating relative positions above or below a given point or element are used in this description to more clearly describe some embodiments of the invention. However, when applied to equipment and methods for use in wells that are deviated or horizontal, such terms may refer to a left to right, right to left, or diagonal relationship as appropriate.

Various types of components for use in well operations can employ any one or more of the following types of communications: electrical communications, hydraulic communications, and/or optical communications. Examples of components can include components of drilling equipment for drilling a well into a subterranean structure, or components of completion equipment for completing a well to allow for fluid production and/or injection operations. Examples of completion equipment components that can perform the various types of communications noted above include sensors, flow control devices, pumps, and so forth.

The various components can be provided at different points in the well. Due to configurations of equipment used for well operations, it can be challenging to deploy mechanisms for establishing electrical communication, hydraulic communication, and/or optical communication with some components.

In accordance with some embodiments, coupler portions can be provided along a well to provide discrete coupling points that can be selectively engaged to equipment for performing electrical communication, hydraulic communication, and/or optical communication. Such coupling points can be considered docking points (or docking stations) for docking or other engagement of a tool that has component(s) that is to communicate (electrically, hydraulically, and/or optically) with other equipment using respective coupler portion(s). In some implementations, the coupler portions can be inductive coupler portions. In further implementations, the coupler portions can include hydraulic coupler portions and/or optical coupler portions.

Electrical communication refers to electrical coupling between components to allow for communication of power and/or data between the components. As noted above, one type of electrical coupling is inductive coupling that is accomplished using an inductive coupler. An inductive coupler performs communication using induction. Induction involves transfer of a time-changing electromagnetic signal or power that does not rely upon a closed electrical circuit, but instead performs the transfer wirelessly. For example, if a time-changing current is passed through a coil, then a consequence of the time variation is that an electromagnetic field will be generated in the medium surrounding the coil. If a second coil is placed into that electromagnetic field, then a voltage will be generated on that second coil, which is referred to as the induced voltage. The efficiency of this inductive coupling generally increases as the coils of the inductive coupler are placed closer together.

Hydraulic communication between components refers to coupling hydraulic pressure between the components to allow for communication of hydraulic pressure for performing a hydraulic control operation. In some examples, hydraulic coupling can be accomplished by use of hydraulic communication ports in the coupler portions that can be sealingly engaged to allow for transfer of hydraulic fluid between the communication ports to respective hydraulic fluid paths.

Optical communication refers to communicating an optical signal between components. To perform optical communication, coupler portions can be provided with lenses and optical signal paths (e.g. optical fibers, optical waveguides, etc.) to communicate optical signals.

FIG. 1 schematically illustrates an example arrangement that includes a casing 102 that extends from an earth surface 104. The casing 102 lines an inner wall of a well 106. Wellhead equipment 108 is provided at the earth surface 104 above the well 106.

As further depicted in FIG. 1, a liner hanger 110 is engaged to an inner wall of the casing 102. The liner hanger 110 can have an anchoring element to anchor the liner hanger 110 against the inner wall of the casing 102. A liner 112 is attached to the liner hanger 110, and the liner 112 extends below the liner hanger 110 into a lower section 114 of the well 106. The liner 112 lines an inner wall of a corresponding part of the lower well section 114. An openhole section 116 of the well is provided below the bottom end of the liner 112.

The casing 102 and liner 112 of FIG. 1 are examples of liner structures, which are structures used to define an inner bore in which equipment can be deployed. In some cases, a liner structure lines an inner wall of a well. Note that there can be other cases in which a liner structure can be deployed concentrically inside another liner structure.

In accordance with some embodiments, coupler portions 118, 120, and 122 are provided on the liner 112. A coupler portion is provided "on" the liner 112 if the coupler portion is attached to or mounted to the liner 112.

In some implementations, the coupler portions 118, 120, and 122 are inductive coupler portions, and more specifically, female inductive coupler portions. Each female inductive coupler portion is to communicatively engage with a corresponding male inductive coupler portion—engagement of the female inductive coupler portion with a male inductive coupler portion forms an inductive coupler to allow for electrical coupling of power and/or data.

Instead of or in addition to inductive coupler portions, the coupler portions 114, 116, and 118 can include hydraulic coupler portions and/or optical coupler portions. A hydraulic coupler portion allows for mating hydraulic engagement with another hydraulic coupler portion, such that hydraulic pressure can be communicated through the engaged hydraulic coupler portions. An optical coupler portion allows for communication of optical signals with a corresponding optical coupler portion.

More generally, communicative engagement of coupler portions can refer to aligning the coupler portions such that they are in position to communicate with each other, such as electrical communication, hydraulic communication, and/or optical communication.

FIG. 1 further shows a control line 124 that is connected to the coupler portions 118, 120, and 122. If the coupler portions 118, 120, and 122 are inductive coupler portions, then the control line 124 includes an electrical cable, which is used to carry electrical power and/or data.

If the coupler portions 118, 120, and 122 include hydraulic coupler portions, then the control line 124 can include a hydraulic control line that contains hydraulic fluids for delivering hydraulic pressure. If the coupler portions 118, 120, and 122 include optical coupler portions, then the control line 124 can include a fiber optic cable. In some implementations, the control line 124 can include multiple ones of an electrical cable, hydraulic control line, and fiber optic cable.

In examples according to FIG. 1, the control line 124 extends inside the inner bore of the liner 112. In other examples, the control line 124 can extend outside of the liner 112, or the control line 124 can be embedded in the wall structure of the liner 112.

Pre-equipping the equipment shown in FIG. 1 with the coupler portions 118, 120, and 122 allows for subsequently deployed components to establish communication with the coupler portions. Examples of components that can establish communication with the coupler portions include sensors (for sensing well characteristics such as temperature, pressure, fluid flow rate, etc.), control actuators (for actuating other components), and so forth. There is also flexibility in coupling different types of components to the coupler portions 118, 120, and 122—such flexibility allows different types of well operations to be performed to accomplish different goals.

Figure 2:
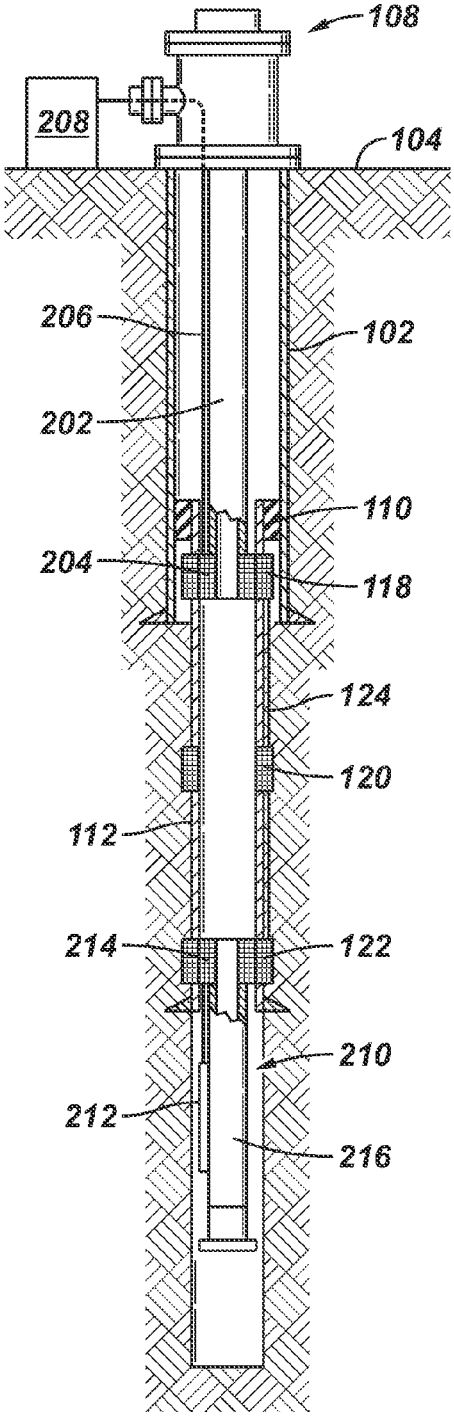

FIG. 2 shows an example arrangement that includes the equipment depicted in FIG. 1, as well as additional equipment. The additional equipment includes a tubing string 202 that has a coupler portion 204 at a lower portion of the tubing string 202, where the coupler portion 204 is for communicative engagement with the coupler portion 118 on the liner 112. The tubing string has a tubing that defines an inner conduit, which can be used for fluid communication (production of fluids or injection of fluids).

In some implementations, the coupler portion 204 on the tubing string 202 includes a male inductive coupler portion for inductive engagement with the female inductive coupler portion 118 once the tubing string 202 is installed in the well. In further implementations, the tubing string coupler portion 204 can include a hydraulic coupler portion and/or an optical coupler portion for communicative engagement with the liner coupler portion 118.

The tubing string 202 further includes a control line 206 that extends from the tubing string coupler portion 204 to earth surface equipment at the earth surface 104. As shown in FIG. 2, the control line 206 extends from the tubing string coupler portion 204 along an outer wall of the tubing string 202 through a feedthrough path of the wellhead equipment 108 to a surface control unit 208. The surface control unit 208 can include devices to perform communication (e.g. electrical communication, hydraulic communication, and/or optical communication) with downhole components through the tubing string coupler portion 204 and liner coupler portions 118, 120, and 122. For example, the surface control unit 208 can include a computer and/or a power supply. In further examples, the surface control unit 208 can include an optical transceiver and/or hydraulic communication equipment.

Note that the control line 206 "extends" to the earth surface 104 if the control line 206 provides communication to the earth surface equipment without having to perform transformation or other type of coupling at any point in the well. For example, an electrical cable extends from a downhole location to the earth surface 104 if the electrical cable provides direct electrical communication from the downhole location (e.g. tubing string coupler portion 204) to surface equipment without passing through any intermediate inductive coupler portion or other intermediate device. Similarly, a hydraulic control line or fiber optic cable extends to the earth surface if the hydraulic control line or fiber optic cable is not passed through intermediate devices that perform some type of conversion on the hydraulic pressure or fiber optic signal.

Although the male coupler portion 204 is shown as being deployed by the tubing string 202 in FIG. 2, note that in other implementations the male coupler portion 204 can be deployed with another type of mechanism, such as a coil tubing, wireline, slickline, and so forth, which provides a control line extending to the earth surface 104.

The equipment shown in FIG. 2 also includes a tool 210 that has various sensors and/or actuators 214 deployed. The tool 210 has a coupler portion 214 for communicative engagement with the liner coupler portion 122. As examples, the coupler portion 214 of the tool 210 can include any one or a combination of the following: inductive coupler portion, hydraulic coupler portion, optical coupler portion.

In examples according to FIG. 2, the tool 210 also includes a tubing section 216, which defines an inner bore through which fluid can pass. In other examples, the tool 210 can be configured without the tubing section 216. Communication with the sensors and/or actuators 212 of the tool 210 is accomplished using the control line 124 and the coupler portions 122 and 214. For example, power can be delivered from the surface control unit 208 down the control line 206 and through the coupler portions 204 and 118 to the control line 124. This power is then passed from the control line 124 through the coupler portions 214 and 122 to the sensors and/or actuators 212. Data (either data from the surface control unit 208 to the sensors/actuators 212, or data from the sensors/actuators 212 to the surface control unit 208) can pass through the same path. Hydraulic communication and/or optical communication would also pass through the same path between the surface control unit 208 and the sensors/actuators 212.

Sensors of the tool 210 can be used to sense various characteristics, such as temperature, pressure, fluid flow rate, and so forth. Actuators of the tool 210 can be commanded (by sending commands to the actuators from the surface control unit 208) to actuate designated devices, such as flow control devices, sealing devices, pumps, and so forth.

Although the sensors/actuators 212 are shown placed relatively close to the liner coupler portion 122 in FIG. 2, note that in other examples, the sensors/actuators 212 can be placed farther away from the liner coupler portion 122.

Installation of the tool 210 at the downhole location corresponding to the liner coupler portion 122 can be accomplished using any of various techniques, such as by use of coil tubing, a tractor, and so forth. Although not depicted in FIG. 2, similar tools can be deployed at other downhole locations corresponding to other liner coupler portions (such as 120 in FIG. 2).

Figure 3:
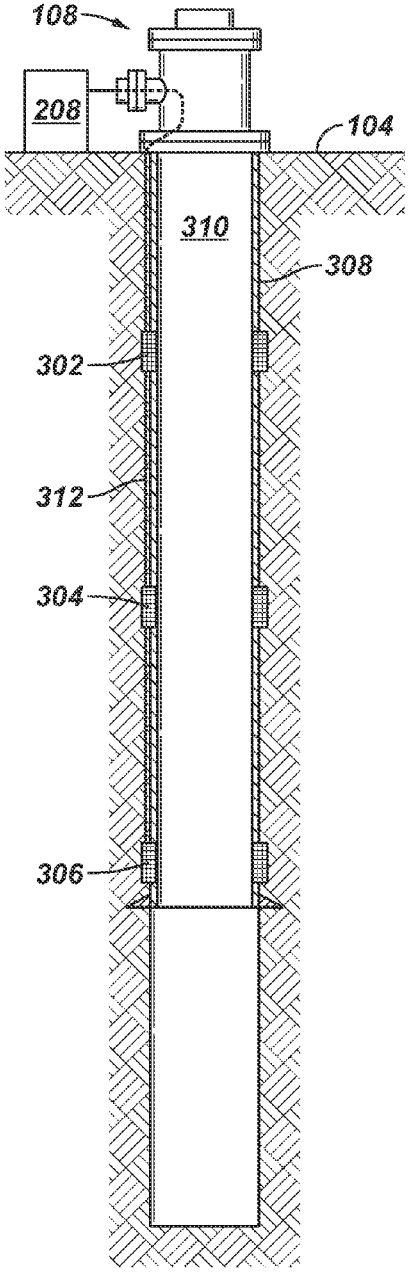

FIG. 3 illustrates a different example arrangement, in which coupler portions 302, 304, and 306 are on a casing 308 that lines a well 310. The coupler portions 302, 304, and 306 (e.g. female coupler portions) are connected to a control line 312, which extends to earth surface equipment including the surface control unit 208. The control line 312 passes through a feedthrough path of the wellhead equipment 108.

As with the implementations depicted in FIGS. 1 and 2, the coupler portions 302, 304, and 306 can each include one or more of: an inductive coupler portion, a hydraulic coupler portion, and an optical coupler portion.

In examples according to FIG. 3, the control line 312 can extend outside the casing 308. In other examples, the control line 312 can extend inside the inner bore of the casing 308, or can be embedded in the wall structure of the casing 308.

As with the example arrangement shown in FIG. 1, additional components can be deployed that are able to communicate with the coupler portions 302, 304, and 306.

Figure 4:
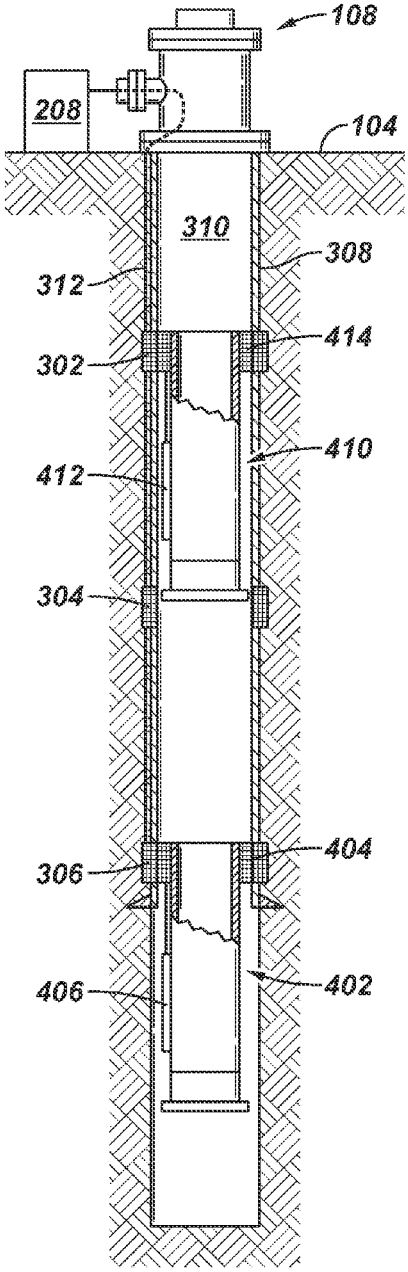

FIG. 4 illustrates the arrangement of FIG. 3 with a tool 402 positioned at a downhole location corresponding to the casing coupler portion 306. The tool 402 has a male coupler portion 404 for communicatively engaging with the casing coupler portion 306 on the casing 308. In addition, the tool 402 has sensors and/or actuators 406, similar to the tool 210 shown in FIG. 2.

Communication between the tool 402 and the surface control unit 208 is accomplished using the control line 312 and coupler portions 404 and 306. Other tools similar to tool 402 can also be deployed for communicative engagement with the other female coupler portions 302 and 304. For example, as further shown in FIG. 4, another tool 410 can be deployed at a downhole location corresponding to the casing coupler portions 302 and 304. The tool 410 has sensors/actuators 412 and a coupler portion 414. The tool coupler portion 414 of the tool 410 is to communicatively engage with the casing coupler portion 302.

Figure 5:
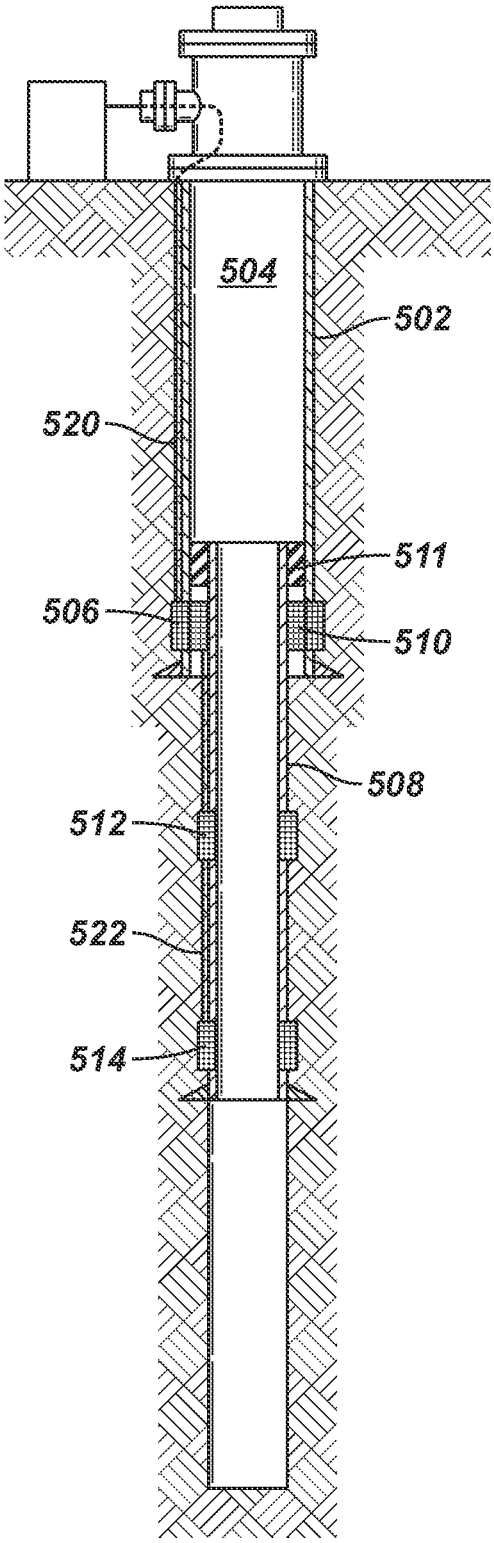

FIG. 5 shows another example arrangement, which includes a casing 502 that lines a wellbore 504. A lower portion of the casing 502 is provided with a coupler portion 506 (in other words, the coupler portion 506 is mounted or otherwise attached to the casing 502). The casing coupler portion 506 can be a female coupler portion.

Additionally, an upper portion of a liner 508 is mounted in the casing 502 using a liner hanger 511. The upper portion of the liner 508 also has a coupler portion 510 (e.g. a male coupler portion) for communicatively engaging with the casing coupler portion 506. In addition, the liner 508 has further coupler portions 512 and 514 provided at discrete positions below the upper coupler portion 510.

A control line 520 extends from the casing coupler portion 506 to earth surface equipment. Another control line 522 is connected to the coupler portions 510, 512, and 514.

During operation, a tool can be lowered through the casing 502 and into the liner 508, where the tool can include one or more coupler portions for communicatively engaging with respective one or more coupler portions 512 and 514 of the liner 508. Communication between earth surface equipment and such a tool can be performed using the control line 520, coupler portions 506 and 510, the control line 522, and a corresponding one of the liner coupler portions 512 and 514 to which the tool is engaged.

Figure 6:
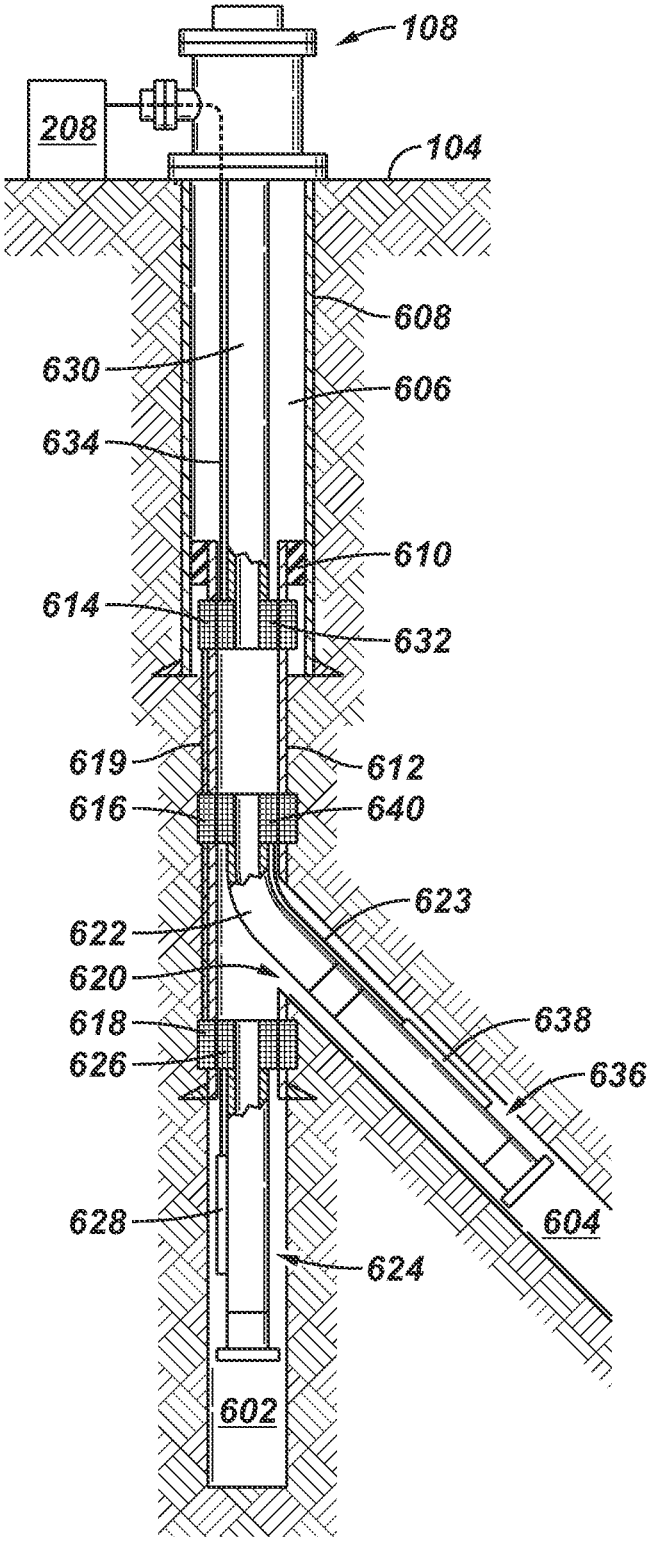
FIG. 6 illustrates an example arrangement including equipment for deploying in a multilateral well, according to some embodiments.

In accordance with further embodiments, FIG. 6 illustrates an example arrangement for a multilateral well that has lateral branches 602 and 604, which extend from a main wellbore 606. A casing 608 lines the main wellbore 606.

A liner 612 is mounted using a liner hanger 610, which is engaged to an inner wall of the casing 608. The liner 612 has coupler portions 614, 616, and 618. A control line 619 is connected to the coupler portions 614, 616, and 618. The liner 612 also has a window 620 through which a lateral tool 622 is able to extend. The window 620 in the liner 612 can be milled using drilling equipment for drilling into the lateral branch 604. The lateral tool 622 extends through the window 620 and into the lateral branch 604.

The lateral tool 636 also has sensors and/or actuators 638, which can be connected by a control line 623 (e.g. electrical cable, hydraulic control line, and/or fiber optic cable) to a coupler portion 640 at an upper portion of the lateral tool 622. The coupler portion 640 of the lateral tool 622 is communicatively engageable with the coupler portion 616 of the liner 612 once the lateral tool 622 is positioned through the window 620 into the lateral branch 604.

As further shown in FIG. 6, another lateral tool 624 can be positioned in the lateral branch 602. The lateral tool 624 has a coupler portion 626 for communicatively engaging with the coupler portion 618 of the liner 612. The lateral tool 624 can also have sensors and/or control devices 628.

FIG. 6 also shows a tubing string 630 deployed inside the casing 608. The lower portion of the tubing string 630 has a coupler portion 632 for communicatively engaging with the coupler portion 614 of the liner 612. A control line 634 extends from the coupler portion 632 of the tubing string 630 along an outer wall of the tubing string 630 and through the wellhead equipment 108 to the surface control unit 208.

In operation, communication between the surface control unit 208 and the lateral tool 624 can be accomplished using the control line 634, coupler portions 632 and 614, control line 619, and coupler portions 626 and 618. Similarly, communication between the surface control unit 208 and the lateral tool 636 can be accomplished using the control line 634, coupler portions 632 and 614, control line 619, and coupler portions 640 and 616.

Figure 7:
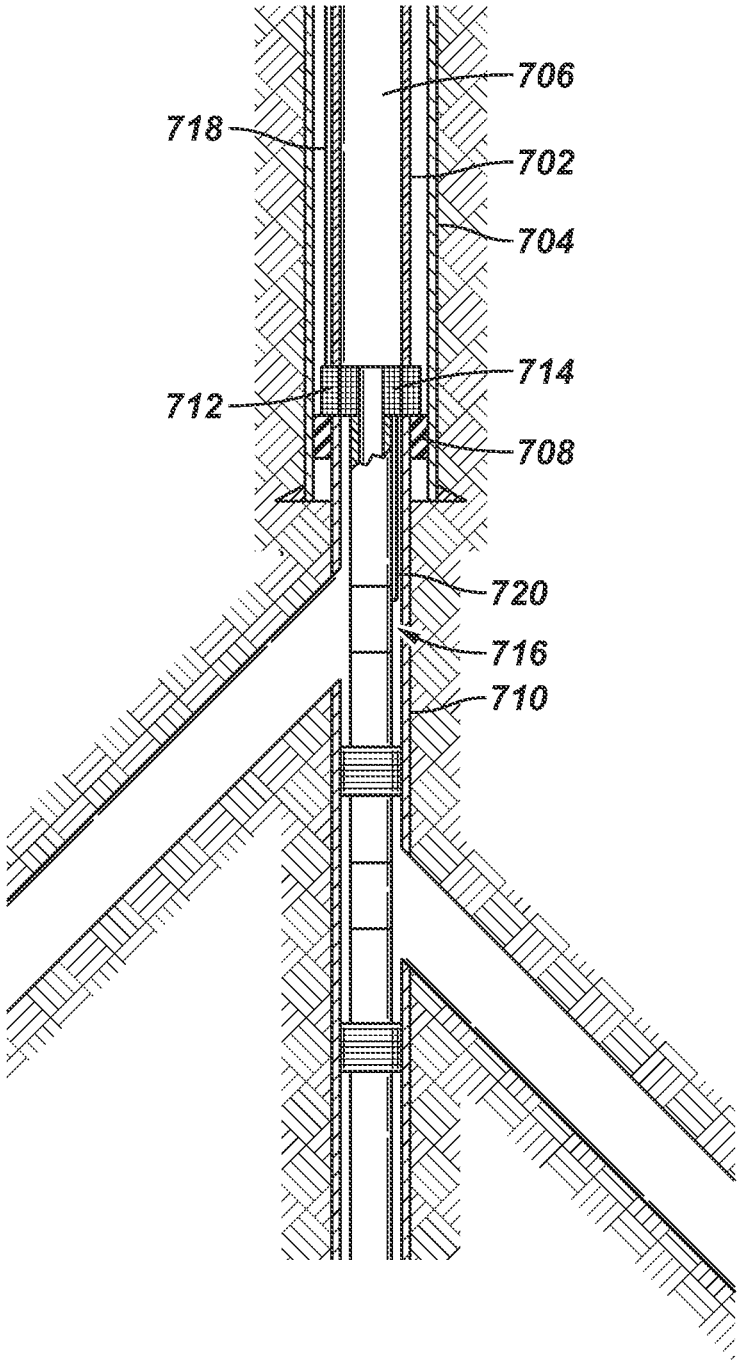
FIG. 7 illustrates an example arrangement that includes a tie-back liner having an inductive coupler portion, according to further embodiments.

FIG. 7 shows a different example arrangement that uses a tie-back liner 702 deployed inside casing 704 that lines a well 706. A tie-back liner can refer to a section of a liner that runs from a liner hanger (such as liner hanger 708) back to the earth surface. The tie-back liner 702 is deployed after a lower liner 710 has been deployed. The lower liner 710 is attached to the liner hanger 708, and extends into a lower section of the well 706.

The tie-back liner 702 may be installed for various reasons. For example, the tie-back liner 702 may provide enhanced pressure capacity (ability to handle elevated internal pressure) as compared to the casing 704. Also, in some cases, the casing 704 may have questionable integrity, in which case the tie-back liner 702 can be installed to enhance integrity inside the well 706.

The lower portion of the tie-back liner 702 has a coupler portion 712. This coupler portion 712 can communicatively engage with a corresponding coupler portion 714 provided at the upper portion of equipment 716. The equipment 716 can include various devices, such as sensors, actuators, and so forth. In some cases, the equipment 716 can be referred to as "intelligent equipment."

A control line 718 extends from the coupler portion 712 of the tie-back liner 704 to earth surface equipment. Additionally, another control line 720 extends from the coupler portion 714 of the equipment 716 to various devices of the intelligent completion equipment 716.

Although FIG. 7 shows just one coupler portion 712 on the tie-back liner 704, it is noted that the tie-back liner 704 can include multiple coupler portions in other examples.

Figure 8:
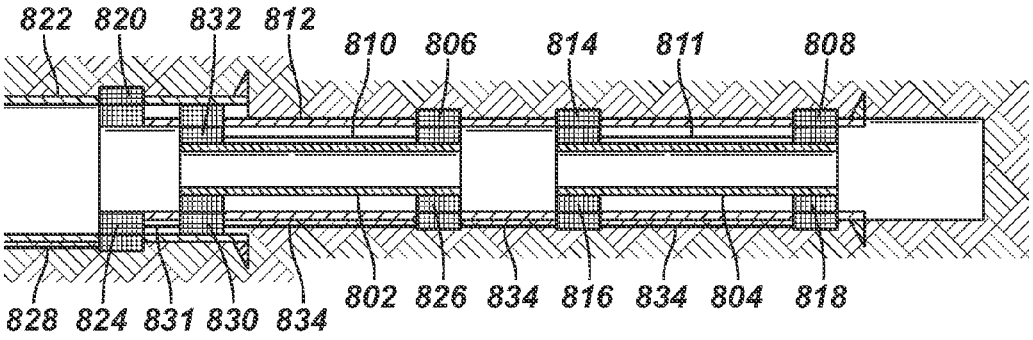
FIG. 8 illustrates an example arrangement in which jumpers are used to communicatively engage with coupler portions on a liner structure, according to further embodiments.

A coupler portion on a liner structure (such as a liner or casing as depicted in the various figures discussed above) may no longer be able to communicate, due to component faults or damage caused by the passage of time or due to downhole well operations that may have caused damage. FIG. 8 illustrates an example arrangement in which jumpers 802 and 804 are used to allow communication of coupler portions experiencing communication faults with a neighboring coupler portion. For example, in FIG. 8, coupler portions 806 and 808 on a liner 812 may not be able to communicate further uphole due to faulty components, such as due to a break in a control line (e.g. control line 834). The faulty liner coupler portions 806 and 808 can be female coupler portions. Additional liner coupler portions 814 and 830 on the liner 812 can also be female coupler portions.

To allow the faulty coupler portion 808 to communicate further uphole, the jumper 804 can be deployed into the bore of the liner 812. The two ends of the jumper 804 can be provided with male coupler portions 816 and 818 that are to communicatively engage with respective liner coupler portions 814 and 808. The male coupler portions 816 and 818 can be connected to each other (such as by an electrical cable, hydraulic control line, or optical fiber 811). In this way, the faulty coupler portion 808 can communicate through the jumper 804 with the neighboring uphole liner coupler portion 814, which in turn is connected by the control line 834 to the liner coupler portion 806.

As noted above, the liner coupler portion 806 can also be faulty, in which case the jumper 802 is deployed into the inner bore of the liner 812 to allow the faulty liner coupler portion 806 to communicate with a casing coupler portion 820 that is on a casing 822. The jumper 802 has male coupler portions 832 and 826 at its two ends to allow the jumper 802 to communicatively engage with respective liner coupler portion 806 and liner coupler portion 830. The male coupler portions 824 and 826 are connected to each other by a control line 810, so that the liner coupler portion 806 can communicate through the jumper 802 to the liner coupler portion 830. The liner coupler portion 830 is connected to another liner coupler portion 824 by a control line 831. The liner coupler portion 824 is positioned adjacent a casing coupler portion 820 to allow for inductive coupling between the coupler portions 824 and 820. The casing coupler portion 820 is electrically connected to a control line 828 to allow the casing coupler portion 820 to communicate with earth surface equipment.

Figure 9:
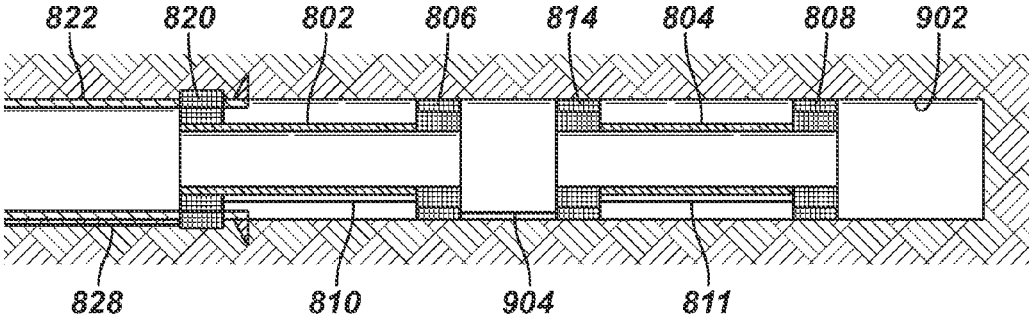
FIG. 9 illustrates an example arrangement in which jumpers are used to communicatively engage with coupler portions in an openhole section of a well, according to other embodiments.

FIG. 9 depicts a variant of the arrangement in FIG. 8. In FIG. 9, the liner 812 is omitted; instead, the coupler portions 806, 814, and 808 are mounted in an openhole section of the well. The coupler portions 806, 814, and 808 can be mounted to an inner surface 902 of the openhole section, such as by use of straddle packers or other mechanisms.

In the example of FIG. 9, the openhole coupler portions 806 and 808 are able to communicate with respective neighboring uphole coupler portions 814 and 820, respectively, using the respective jumpers 804 and 802. The openhole coupler portions 806 and 814 are connected by a control line 904.

In other examples, a jumper can bypass at least one intermediate coupler portion. For example, in either FIG. 8 or 9, a jumper of increased length can be deployed to couple the coupler portion 808 to the coupler portion 820, while bypassing coupler portions 806 and 814.

Figure 10:
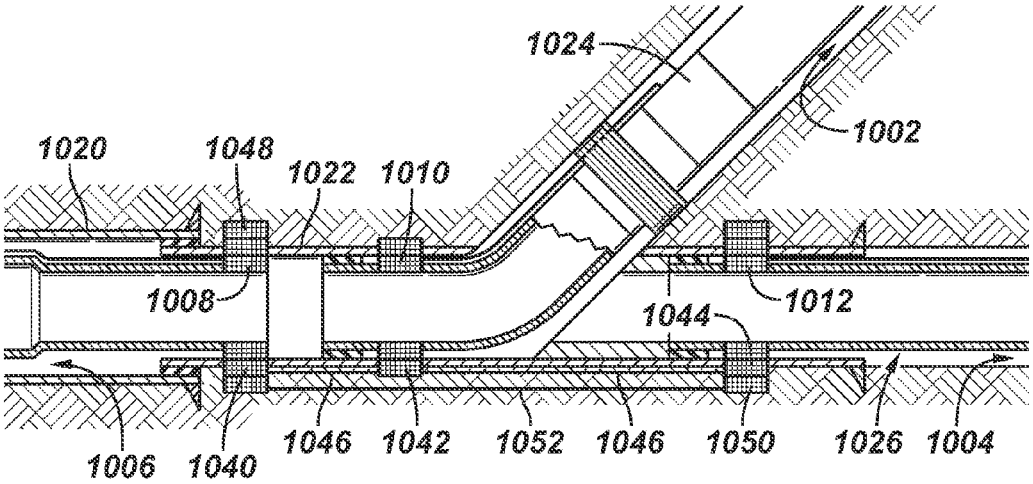
FIG. 10 illustrates an example arrangement that includes a jumper for connecting coupler portions for lateral branches, according to further embodiments.

FIG. 10 illustrates another example arrangement which includes equipment deployed in a multilateral well having later branches 1002 and 1004 that extend from a main wellbore 1006. The equipment is similar in arrangement to that depicted in FIG. 7, and includes a casing 1020 and a liner 1022. The equipment includes coupler portions 1008, 1010, and 1012. The coupler portion 1010 is to establish communication with a tool 1024 in the lateral branch 1002, while the coupler portion 1012 is to establish communication with a tool 1026 in the lateral branch 1004.

As further shown in FIG. 10, liner coupler portions 1040, 1042, and 1044 are provided on the liner 1022. The liner coupler portions 1040, 1042, and 1044 are aligned with respective coupler portions 1008, 1010, and 1012. The liner coupler portions 1040, 1042, and 1044 are connected by a control line 1046.

FIG. 10 further depicts a jumper arranged outside the liner 1022. The jumper includes coupler portions 1048 and 1050 that are interconnected by a control liner 1052. The coupler portions 1048 and 1050 are aligned with respective coupler portions 1040 and 1044. In case of a failure (such as failure of the control line 1046) that prevents communication with the lower coupler portion 1044, the jumper can be used to establish communication with the lower coupler portion 1044.

Figure 11:
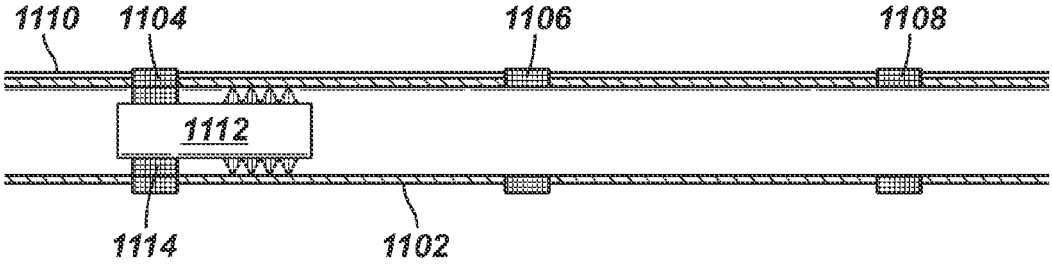
FIG. 11 illustrates an example arrangement that includes a tubular structure having coupler portions, and a tool in the tubular structure, according to yet further embodiments.

Although the foregoing example arrangements include equipment for deployment with a liner structure or for deployment in a well, mechanisms or techniques according to some embodiments can also be deployed with other structures or outside a well environment. For example, as shown in FIG. 11, female coupler portions 1104, 1106, and 1108 are deployed at various discrete points along a tubular structure 1102 (the tubular structure 1102 can have a generally cylindrical shape, or can have any other shape). The tubular structure 1102 can be a production tubing (e.g. to produce fluids in a well). In other examples, the tubular structure 1102 can be a pipeline, such as one deployed on an earth surface or on a seafloor for carrying fluids (e.g. hydrocarbons, water, etc.).

The female coupler portions 1104, 1106, and 1108 on the tubular structure 1102 can be connected to a control line 1110 (e.g. electrical cable, hydraulic control line, and/or fiber optic cable). As shown in FIG. 11, a tool 1112 can be run inside the inner bore of the tubular structure 1102. The tool 1112 has a male coupler portion 1114 for communicatively engaging with any of the female coupler portions 1104, 1106, and 1108. The tool 1112 can be used to perform various operations in the inner bore of the tubular structure 1002, such as to brush or clean the inner wall of the tubular structure 1102. In other examples, the tool 1112 can include sensors to sense characteristics inside the tubular structure 1102 (e.g. check for corrosion, etc.).

During operation, communication (of power and/or data) can be performed using the control line 1110 and through one or more of the coupler portions 1104, 1106, and 1108 with the coupler portion 1114 of the tool 1112.

Figure 12:
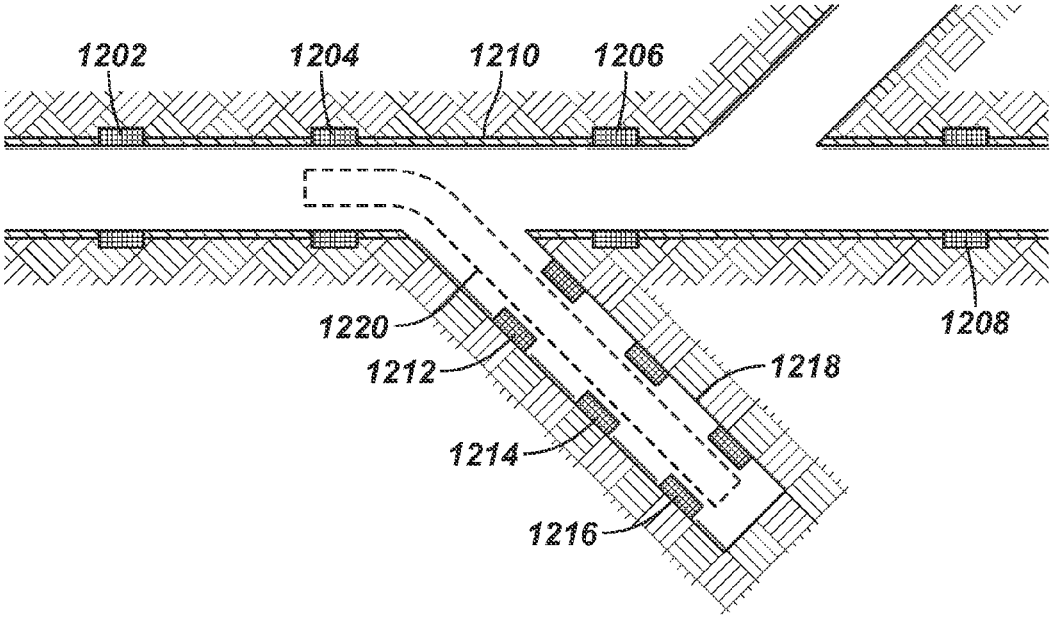
FIG. 12 illustrates another example arrangement according to other embodiments.

FIG. 12 shows another example arrangement, which includes equipment provided in a multilateral well. Liner coupler portions 1202, 1204, 1206, and 1208 are arranged along a liner 1210. The liner coupler portions 1202, 1204, 1206, and 1208 can be coupled by a control line (not shown). In addition, coupler portions 1212, 1214, and 1216 can be provided in a lateral branch 1218. Lower completion equipment 1220 can be provided, which can be used that has respective coupler portions to communicate with coupler portion 1204 and the lateral coupler portions 1212, 1214, and 1216.

However, if liner coupler portion 1204 becomes defective for some reason, then the lower completion equipment 1220 can be removed, and re-installed with a jumper to allow communication with a further uphole coupler portion 1202.

In the foregoing description, numerous details are set forth to provide an understanding of the subject disclosed herein. However, implementations may be practiced without some or all of these details. Other implementations may include modifications and variations from the details discussed above. It is intended that the appended claims cover such modifications and variations.

What is claimed is:

1. A system comprising:

a liner structure to line a well, the liner structure having a plurality of inductive coupler portions to provide discrete points of communication;

a control line connected to at least one of the coupler portions, wherein the control line is to extend to earth surface equipment; and a jumper comprising a first inductive coupler portion, a second inductive coupler portion, and an intermediate portion between the first and second inductive coupler portions, wherein the jumper is configured to communicatively couple to a particular one of the inductive coupler portions on the liner structure to allow continued communication with the particular coupler portion in a presence of a fault, wherein the jumper is positioned with the first inductive coupler portion on a first side of the fault and the second inductive coupler portion on a second side of the fault opposite the first inductive coupler portion, and wherein the jumper is deployed in an inner bore of the liner structure.

2. The system of claim 1, wherein the fault is a fault of the control line that prevents communication with the particular inductive coupler portion without the jumper.

3. The system of claim 1, wherein the jumper is to be provided outside the liner structure to communicatively couple to selected ones of the plurality of inductive coupler portions including the particular coupler portion.

4. The system of claim 1, wherein the inductive coupler portions include hydraulic coupler portions, and the control line includes a hydraulic control line.

5. The system of claim 1, wherein the inductive coupler portions include optical coupler portions, and the control line includes a fiber optic cable.

6. The system of claim 1, wherein the liner structure includes at least one of a casing or a liner.

7. The system of claim 1, wherein the liner structure includes a liner, the system further comprising: a tubing string for deployment in the well, wherein the tubing string has a coupler portion to communicatively engage with one of the inductive coupler portions on the liner.

8. The system of claim 7, further comprising a casing to line a segment of the well, wherein the tubing string is deployed in the casing; and a liner hanger engaged in the casing, wherein the liner extends from the liner hanger into another segment of the well.

9. The system of claim 1, further comprising a tool deployable through the liner structure and having a coupler portion to communicatively engage with one of the inductive coupler portions on the liner structure.

10. The system of claim 9, wherein the tool is for deployment in a lateral branch extending from a main wellbore of the well.

11. A method comprising:

positioning first inductive coupler portions in an openhole section of a well;

lowering a jumper into the well, the jumper having a first inductive coupler portion, a second inductive coupler portion, and an intermediate section between the first and second inductive coupler portion, wherein the jumper is configured to engage at least one of the first coupler portions; and positioning the jumper in the well in an inner bore relative to the inductive coupler portions with the first and second inductive coupler portions bridging a fault, wherein the jumper is configured to bypass the fault.

12. The method of claim 11, wherein the first inductive coupler portions and jumper are selected from among inductive coupler portions, hydraulic coupler portions, and optical coupler portions.

* * * * *